United States Patent [19]

Kao

[11] Patent Number: 4,627,738

[45] Date of Patent: Dec. 9, 1986

[54] WATCHCASE AND WATCHFRAME ASSEMBLY

[76] Inventor: Chung-fu Kao, 2440 S. Hacienda Blvd., No. 112, Hacienda Heights, Calif. 91745

[21] Appl. No.: 695,279

[22] Filed: Jan. 28, 1985

[51] Int. Cl.[4] ..... G04B 37/00

[52] U.S. Cl. ..... 368/281

[58] Field of Search ..... 368/276–278, 368/280–283, 299–300

[56] References Cited

U.S. PATENT DOCUMENTS

| | | | |
|---|---|---|---|
| 1,986,328 | 1/1935 | Dreyfus | 368/283 |
| 1,991,284 | 2/1935 | Lewbel | 368/281 |
| 2,706,379 | 4/1955 | Fitzpatrick, Jr. | 368/281 |
| 4,117,660 | 10/1978 | Walker | 368/299 |
| 4,346,464 | 8/1982 | Wenger | 368/289 |
| 4,502,791 | 3/1985 | Goy | 368/308 |

*Primary Examiner*—Bernard Roskoski

*Attorney, Agent, or Firm*—David N. Makous

[57] ABSTRACT

A watchcase and watchframe suitable for mating and unmating one with the other by the use of a sealing means suitable for slidably translating the case within the frame and providing a substantially contiguous fit of the case within the frame.

3 Claims, 3 Drawing Figures

WATCHCASE AND WATCHFRAME ASSEMBLY

BACKGROUND

This invention relates to a a novel and improved arrangement for the reversible mating, coupling, or mounting of a watchcase within a watchframe.

Watchbands, watchframes and watchcase designs are comprised of many different styles, colors, shapes, sizes, and designs. It is often desirable that the watch wearer-user have a watch which is coordinated with the color, fashion, and design of the wearer.

To have this feature of coordination requires generally that the wearer acquire many different watches, each watch having a suitable color, style, and design consistent with the wearer's clothing and fashion wear. It is advantageous to have a watch which is suitable for many different colors, styles, clothing or fashion, or to have a set of watches which can be made adaptable to many different colors, styles, clothing or fashion wear at a relatively inexpensive price. The only alternative is to acquire many different watches at a relatively great cost to the wearer.

Presently in the timepiece industry there are reversible mounting, assembly, and coupling case and frame apparatus available. These apparatus use exterior fastening means such as snaps, lugs, screws, clasps, bands, and tabs which cause the appropriate fixation of the watchcase within the frame. Some of these fastening means are disclosed and illustrated in the following patents: U.S. Pat. No. 3,492,809 entitled WRIST WATCH MOVEMENT AND WRISTBAND COMBINATION issued Feb. 3, 1970; U.S. Pat. No. 2,219,277 entitled MOUNTING FOR WATCHCASES, issued Oct. 22, 1940; U.S. Pat. No. 3,672,157 entitled COMBINED WATCH AND CONTINUOUS WATCH BAND, issued June 27, 1972. Other related wrist watch assembly art is disclosed and illustrated in U.S. Pat. No. 4,023,347 entitled WRISTWATCH CASING AND BAND CONSTRUCTION, issued May 17, 1977; U.S. Pat. No. 2,799,134, entitled WATCH MOVEMENT HOLDER RING, issued July 16, 1957; and U.S. Pat. No. 3,675,414, issued July 11, 1972 entitled WRIST WATCHES.

Furthermore, this invention provides an assembly means without the use of any permanent adhesive, snaps, lugs, screws, clasps, exterior bands, deformable plastic tabs, or the like.

Furthermore, it is desirable that in any assembly and disassembly of a watchcase and its watchframe the means of assembly and fastening of the case to the frame be such that the fastening means not be readily perceptible in the course of ordinary wearing and usage after the watch has been assembled. This is done for aesthestic and comfort reasons by avoiding the appearance of the fastening means, or the appearance that the watch is one that can be routinely assembled and disassembled, or discomfort of the fastening means with the wearer's body.

This invention provides a novel and improved apparatus for reversibly mating, coupling and mounting a watchcase from within a watchframe by a slidable means. The apparatus is smoother in operation, more aesthetic, and easier for the ordinary human user to accomplish, than available in any prior art.

Furthermore, because the case can slide within the frame from the bottom portion of the frame to the top, any slot in the frame for the watchwind and stem can be hidden from view upon the completion of its assembly.

Furthermore, the provision of a slight rim at the top of the frame additionally aids in disguising the assembly means, further improving the aesthetic characteristics of this watch.

Furthermore, the present invention provides a means for slidably assembling a metal frame and metal case without scratching and marring the surface of either the case or frame.

SUMMARY

The present invention comprises a case and frame which can be mated into a single watch unit and unmated by slidable translation of the watchcase into the watchframe.

It is the object of this invention to provide for a case and frame which can be slidably assembled by the application of human digital pressure or its equivalent to the bottom of the case after fixing the case within the frame in the appropriate alignment, such that the assembled watch can be worn and used without disassembling under ordinary watch usage and wear conditions, and after use can be slidably disassembled in reverse manner.

It is a further object of this invention to provide for a slidable assembly means which can be used without scratching or marring the surface of either the watchcase or watchframe.

It is a further object of this invention to provide an improved arrangement for reversibly mating and unmating a case within a frame comprising a single watch unit, wearing it in the ordinary manner, and achieving an improved aesthetic appearance which does not disclose the reversibility or manner of assembly of the watch.

It is a further object of this invention to use a sealing means comprised of a suitable material which allows for one mating surface to slidably translate over the other mating surface and which provides a contiguous fit of the sealing means between the mating surfaces of the case and the frame and which fit renders the case stationary within the frame under ordinary usage conditions, such that no disassembly of the watchcase and watchframe will occur, but which can be suitably unmated upon the application of human digital pressure by slidably translating the watchcase from the watchframe.

The manners, methods and apparatus in which these and other objects of this invention can be attained appear further from the detailed description of the preferred embodiments and other embodiments which follow, the examples, and the accompanying drawings.

DETAILED DESCRIPTION OF THE INVENTION

Figure 1:
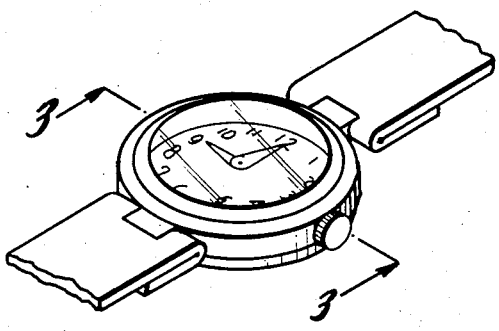
FIG. 1 is a perspective of the preferred embodiment of the watchcase and the watchframe after assembly into one watch unit, illustrating the mating of the case and frame and the use of sealing means (not visible) to fix the case within the frame.
Figure 2:
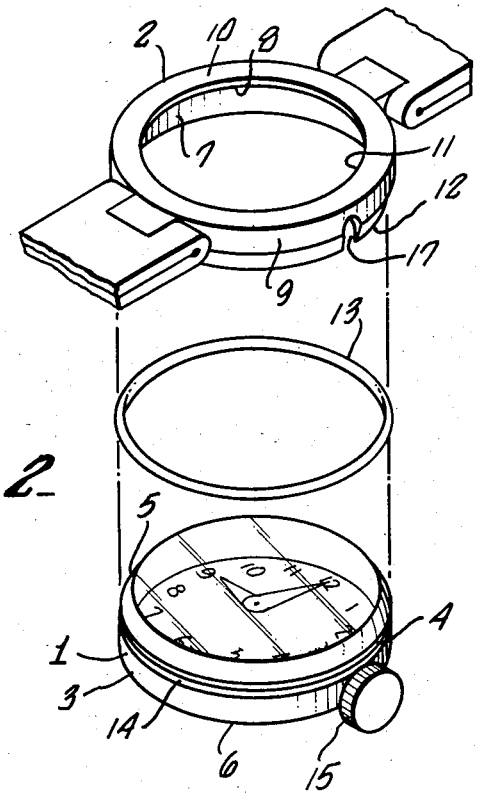
FIG. 2 is an exploded perspective view of the watch unit of FIG. 1 illustrating the preferred embodiment and the relative alignment of the watchcase, its mating surface, its shoulder, its top and back surfaces, the watchframe, its mating surface, its interior rim, its exterior surface and exterior rim, its top and bottom openings, the sealing means for translating and mating the case and frame, and the recessed groove within the case.
Figure 3:
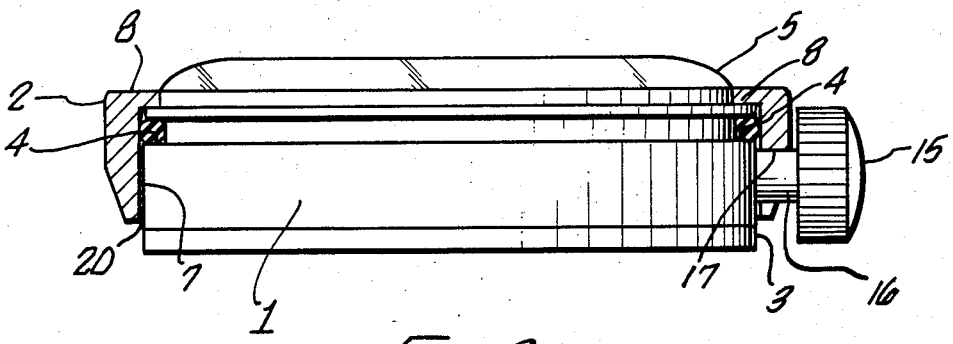
FIG. 3 is a partial section along the lines 3—3 of FIG. 1 illustrating the relationship of the case and frame upon the complete mating of the case within the frame and the use of the sealing means to provide a contiguous fit between the case and frame, and the abutment of the shoulder with the interior rim.

The preferred embodiment of the invention is as illustrated in FIGS. 1, 2 and 3 of the drawings. The preferred embodiment is a watch comprised of a watchcase and watchframe suitable for mating one with the other and unmating one from the other. The watch is comprised of the watchcase 1 and the watchframe 2. Suitable bands, chains, fobs, clasps, and other devices can be added to make the watch a wristwatch, or other portable or fixed timepiece.

The watchcase (case) 1 is comprised of a movement within it which is driven in several ways, usually by a spring or battery. The case exterior is comprised of a top surface 5, which in the preferred embodiment is a crystal cover over the dial of the watch and is made of glass, plastic or other transparent material. The remainder of the watchcase 1 is comprised of the normal exterior surface 3, a back surface 6, a recessed groove portion 14, a shoulder 4, a watchwind 15, and a stem 16. The watchcase can be made of any appropriate material. In the preferred embodiment, it is made of metal.

The watchframe (frame) 2 comprises the portion of the fully assembled watch which communicates with the watchband, fob, or other means of using or carrying the watch. The frame 2 has a normal interior surface 7, a normal exterior surface 9, an interior rim 8, and an exterior rim 10. The rim 8, 10 define and bound a top opening 11. The normal interior surface 7 and normal exterior surface 9 define and bound a bottom opening 12 within the frame 2.

Both the watchcase and watchframe have a mating surface. In the watchcase, it is denominated the normal exterior surface 3. In the watchframe, it is denominated the normal interior surface 7. It is these surfaces which move proximately by each other upon the mating and unmating of the case to the frame, as more fully described hereafter.

The completed assembly of the watchcase 1 with the watchcase 2 is denominated as mating. It might also be called coupling or mounting. According to the invention, the mating is accomplished primarily by the use of a sealing means 13. In the preferred embodiment as depicted in FIGS. 1, 2 and 3, the sealing means is an annular rubber ring fixed within the recessed groove portion 14 of the watchcase 1. Its fixation is such that it does not vary from its placement during the ordinary mating and unmating of the case and frame according to the invention.

It is not necessary in all embodiments that the sealing means be fixed within a recessed groove of the case. All that is required is that the sealing means be fixed in some manner about either the exterior surface 3 of the case, or the interior surface 7 of the frame.

The sealing means has at least two functions. It is a lubricant providing a means for slidably translating or moving the watchcase into the watchframe. It is also a seal such that upon complete mating of the case within the frame, the sealing means maintains the case in its final mated position within the frame, as illustrated in FIG. 3. The tightness of the seal in the fully mated position must be such as to overcome the force of gravity and the shaking or movement accompanying ordinary wearing and usage of the watch. Many rubbers and plastics have this capability and are readily available. In the preferred embodiment an ordinary grade of commercial rubber as used in commercial washers of the same relative size as the watchcase is the sealing means.

In the preferred embodiment, the dimensions of the case, frame, the interior surface 3 and exterior surface 7, and the sealing means are such that upon mating, the sealing mens provides a substantially contiguous fit between the exterior surface 3 of the watchcase and the interior surface 7 of the frame, yet there is maintained a separation 20 between the two surfaces 3, 7.

The sealing means cannot be such that upon fixation of the case in its final mated position within the frame the case cannot be removed from the frame by the application of human digital pressure or its equivalent. The sealing should not be permanent but rather reversible.

In the preferred embodiment, the sealing means is comprised of a rubber annular ring or seal 13 fixed within the recessed groove 14 and extends about the full circumference of the normal exterior surface 3 of the watchcase 1. Fixing the ring 13 about the full circumference provides a substantially contiguous contact by the sealing means with the entire normal exterior surface 3 of the case and the normal interior surface 7 of the frame 2, and a contiguous fit, making the slidable translation balanced and uniform about the circumference of the case and frame, and provides that the mating of the case with the frame is complete, fixed, and useful for wear.

In the preferred embodiment as illustrated in FIGS. 1–3, the annular seal 13 has an internal diameter approximately equal to the innermost diameter of the recessed groove 14, and an external diameter, such that it extends beyond the normal exterior surface 3 of the seal by a differential amount approximately equal to the space 20. This differential of the seal provides for the tightness of the fit of the case and frame, while also preventing any damaging or inhibiting contact of the surfaces 3, 7 during translation and mating.

Should the seal's external diameter exceed this differential amount, then it is likely that there will be unsatisfactory attempts at mating the case and frame as the seal can obstruct or hinder the passage of the case into the interior of the frame. On the other hand if the seal has an inadequate diameter external to the groove, then the case will move into the frame but can not properly mate with the frame as there is no sealing means sufficient to form a contiguous fit of the surface 3 with the interior surface 7, and no fixation can occur as the case can readily displace itself from the interior of the frame by the force of gravity alone.

In the preferred embodiment, upon mating, the shoulder 4 of the case substantially abuts the interior rim 8 of the frame, thus providing a limitation to the case in its translation within the frame, prohibiting its passage all the way through the top opening 11 of the frame.

Additionally, in the wearing of the preferred embodiement, the topwards force provided by the wearer's wrist to the back 6 of the case once the case is assembled within the frame in its fully mated position as in FIGS. 1 and 3 can bring pressure to bear on the rim 8 by the shoulder 4 which can assist in the continued mating of the case and frame. However, this wrist force is not necessary according to the invention.

Furthermore, the preferred embodiment provides for the passage of a watchwind stem 16 into the frame slot 17 upon the mating of the case and frame. Because the case is mated through bottom opening 12 to the top opening 11, the slot 17 can be hidden from the view of the ordinary wearer upon the assembly of the case and frame, as the wind 15 hides the slot from view.

The invention is not limited to the frame being uppermost to the case after assembly, but also includes the placement of the case downwards into the frame, and having the interior rim 8 fixed at the bottom opening, instead of at the top opening of the frame.

Other embodiments of the invention include the use of a sealing means which can be placed upon and removed from the normal exterior surface of the watchcase. In this embodiment, there is no recessed groove, such as 14. The sealing means can be added prior to the mating of the case to the frame. Elastic features in the sealing means could by stretch provide for fixation of the sealing means around the normal exterior surface 3 of the watchcase and assure a fixation of the sealing means and a contiguous fit during and after the translation of the case within the frame.

An additional embodiment of the invention includes the fixation of the sealing means about the interior surface of the frame by an adhesive or other means sufficient to fix the sealing means about the interior surface of the frame. In this embodiment, the case has a normal exterior surface without any recessed groove or sealing means affixed thereto and could be moved in and out of the frame by the same slidable translation of the case within the frame.

The mating of the case and the frame in the preferred embodiment is accomplished in the following manner. Maintaining the watchframe 2 in a stationary 1, the top surface 5 of the watchcase is placed into the bottom opening 12 of the frame. Thereafter sufficient pressure by digital means or other equivalent can be applied to the back surface 6 of the watchframe, moving the watchcase further into the watchframe, beginning slidable translation. At some point, contact of the sealing means 14 with the normal interior surface 7 occurs. At such point as the case is sufficiently translated through the frame, the shoulder portion 4 of the case abuts the interior rim 8 of the frame 2.

In the event that a watchwind stem 16 is part of the case, then alignment of the stem 16 with slot 17 of the frame must be accomplished prior to slidably translating the case within the frame. The frame 2 should be designed that the slot 17 does not impede the complete mating of the case with the frame and the abutment of the shoulder 4 with the interior rim 8. Upon abutment of the shoulder, the mating is complete.

To unmate the case and frame, the reverse is undertaken. Again, maintaining the watchframe in a stationary position relative to the case, sufficient digital pressure or its equivalent is applied on the top surface 5 of the case pressing towards the back 6 of case. As pressure is applied the shoulder moves away from the rim, and eventually the entire case is removed from the frame.

Such rapid assembly and disassembly provides for the ready assembly and disassembly of the case with any frame compatible with the case. One can have a set of watchcases and watchframes, with each case compatible with each frame, such that the user can select the frame of the user's choice, replace the watchcase within the frame, and wear or use the watch. Thus, compatibility of design, style, color, and fashion can be achieved by the user.

The above examples are in no way a limitation on the scope of the invention but rather illustrate applications of the invention and the preferred embodiment and other uses of this new invention.

Although the present invention has been described in considerable detail with reference to certain preferred versions thereof, certain descriptions and certain drawings, other versions are possible. Therefore, the spirit and scope of the appended claim should not necessarily be limited to the description in the preferred versions contained herein.

I claim:

1. A watchcase and a watchframe suitable for mating and unmating one with the other comprising:

(a) A watchcase having a mating surface which surface has a recessed groove therein, a shoulder, a top surface and a back surface;

(b) A watchframe having a mating surface, an interior rim, a normal exterior surface, an exterior rim, a top opening, and a bottom opening;

(c) A mating means substantially fixed within said recessed groove of the mating surface of the watchcase which means is suitable for mating the watchcase with the watchframe by slidably translating the mating surface of the watchcase within the mating surface of the watchframe to provide a substantially contiguous fit between the mating surfaces of said watchcase and watchframe;

(d) Said watchcase and watchframe mating by maintaining the watchframe stationary relative to the watchcase, placing the top surface of the watchcase into the bottom opening of the watchframe, applying sufficient pressure to the back surface of the watchframe, slidably translating the watchcase into the watchframe, substantially abutting said watchcase shoulder with said interior rim of the watchframe, said mating means substantially abutting both the mating surface of the watchframe forming a substantially contiguous fit between both mating surfaces; AND (e) Said watchcase and watchframe unmating by maintaining the watchframe stationary, applying sufficient pressure to the top surface of the watchcase, slidably translating the watchcase out of the watchframe.

2. A watchcase and watchframe as in claim 1 wherein said watchcase is further comprised of a wind and stem, said watchframe having a slot between its mating surface and its normal exterior surface, such that upon slidably translating the watchcase into the watchframe the stem moves within the slot.

3. A watchcase and watchframe as in claim 1 wherein said mating means is an annular ring comprised of natural rubber, synthetic rubber or plastic.

* * * * *